US011146026B1

(12) United States Patent
Xie et al.

(10) Patent No.: US 11,146,026 B1
(45) Date of Patent: Oct. 12, 2021

(54) ELECTRICAL CONNECTOR HAVING SHIELDING FUNCTION

(71) Applicant: Dongguan Way Way Electronic Technology Co.,Ltd, Dongguan (CN)

(72) Inventors: Yue-Hua Xie, Dongguan (CN); Ze-Kun Wang, Dongguan (CN)

(73) Assignee: Dongguan Way Way Electronic Technology Co., Ltd, Dongguan (CN)

( * ) Notice: Subject to any disclaimer, the term of this patent is extended or adjusted under 35 U.S.C. 154(b) by 0 days.

(21) Appl. No.: 16/920,754

(22) Filed: Jul. 6, 2020

(51) Int. Cl.

| | |
|---|---|
| ***H01R 13/6588*** | (2011.01) |
| ***H01R 13/6598*** | (2011.01) |
| ***H01R 12/72*** | (2011.01) |
| ***H01R 13/6585*** | (2011.01) |
| ***H01R 24/50*** | (2011.01) |

(52) U.S. Cl.
CPC ..... *H01R 13/6588* (2013.01); *H01R 12/724* (2013.01); *H01R 13/6585* (2013.01); *H01R 13/6598* (2013.01); *H01R 24/50* (2013.01)

(58) Field of Classification Search
CPC ..... H01R 24/50; H01R 13/6585; H01R 2103/00; H01R 12/724; H01R 12/721; H01R 13/111; H01R 13/4361; H01R 13/6272; H01R 13/6315; H01R 13/639; H01R 13/6477; H01R 13/659; H01R 2101/00; H01R 24/42; H01R 24/44; H01R 9/0503; H01R 9/0518
See application file for complete search history.

(56) References Cited

U.S. PATENT DOCUMENTS

| | | | | | |
|---|---|---|---|---|---|
| 5,169,343 | A * | 12/1992 | Andrews | H01R 13/6585 | 439/607.11 |
| 5,334,050 | A * | 8/1994 | Andrews | H01R 24/50 | 439/579 |
| 5,344,340 | A * | 9/1994 | Bouleau | H01R 24/50 | 439/581 |
| 5,842,872 | A * | 12/1998 | Hosier, Sr. | H01R 24/50 | 439/63 |
| 6,071,127 | A * | 6/2000 | Acke | H01R 24/50 | 439/63 |
| 6,257,927 | B1 * | 7/2001 | Suzuki | H01R 12/724 | 439/579 |
| 6,575,761 | B1 * | 6/2003 | Regnier | H01R 9/0515 | 439/108 |
| 7,118,381 | B2 * | 10/2006 | Weidner | H01R 24/50 | 439/63 |
| 8,282,415 | B1 * | 10/2012 | Foltz | H01R 13/514 | 439/579 |
| 10,601,153 | B2 * | 3/2020 | Maki | H01R 13/639 | |
| 2011/0039423 | A1 * | 2/2011 | Blasick | H01R 24/50 | 439/65 |
| 2021/0226369 | A1 * | 7/2021 | Mullinger-Bausch | H01R 12/721 | |

* cited by examiner

*Primary Examiner* — Edwin A. Leon
*Assistant Examiner* — Matthew T Dzierzynski
(74) *Attorney, Agent, or Firm* — Li & Cai Intellectual Property Office

(57) ABSTRACT

An electrical connector having a shielding function includes a shell, a main body, a plurality of sleeves, a plurality of terminals, a plurality of terminal seats, and a shielding sheet. The shielding sheet includes a plurality of spacers and a rear baffle. The spacers of the shielding sheet are configured to space apart the terminals, and the rear baffle of the shielding sheet is configured to insulate the two terminals in the rear from the external environment.

10 Claims, 5 Drawing Sheets

ELECTRICAL CONNECTOR HAVING SHIELDING FUNCTION

FIELD OF THE DISCLOSURE

The present disclosure relates to an electrical connector, and more particularly to an electrical connector having a shielding function.

BACKGROUND OF THE DISCLOSURE

Currently, since a ground lug of a conventional electrical connector is a stamping component, a fissure can easily occur during a manufacturing process of the stamping component, so that a shielding effect between the conventional electrical connector and a mating connector is underperforming and does not meet high-frequency transmission requirements. Present vehicle driver assistance and autopilot systems have gradually higher requirements for data transmission speed, such that signal shielding has become a difficult issue. Moreover, since a plurality of components are usually configured between adjacent terminals of the conventional electrical connector, or between terminals and the external environment of the conventional electrical connector, such as to form the spacing therebetween, the manufacturing cost is relatively high.

SUMMARY OF THE DISCLOSURE

In response to the above-referenced technical inadequacies, the present disclosure provides an electrical connector having a shielding function that is configured to effectively achieve a shielding effect and a relatively high data transmission speed, thereby reducing the manufacturing cost.

In one aspect, the present disclosure provides an electrical connector having a shielding function. The electrical connector includes a shell, a main body, a plurality of sleeves, a plurality of terminals, a plurality of terminal seats, and a shielding sheet. The shell has two corresponding sides that respectively have a mating end and a first connection end. The shell has a mating space inside thereof. The mating end has a first opening, and the first opening is in spatial communication with the mating space. The main body has a second connection end formed on one side thereof. The second connection end of the main body and the first connection end of the shell are connected with each other. The main body has an accommodating space inside thereof, the main body has a second opening formed on one side thereof near the second connection end, the main body has a third opening formed on one side thereof away from the second connection end, and the second opening and the third opening are in spatial communication with the accommodating space. The sleeves are fixed on the shell and the main body, and the sleeves extend into the mating space. Each of the terminals is in an L shape. Each of the terminals has a fixing portion, a contacting portion, and a pin, the contacting portion is connected to one end of the fixing portion, the pin is connected to another end of the fixing portion, and the contacting portion and the pin are perpendicular to each other. The terminal seats have the fixing portions of the terminals respectively fixed thereon. The contacting portions and the pins of the terminals extend out of the terminal seats, the terminal seats and the terminals are assembled in the accommodating space of the main body through the third opening, the terminal seats are partially and respectively embedded into the sleeves, and the contacting portions of the terminals respectively extend into the sleeves. The shielding sheet has a plurality of spacers and a rear baffle. The spacers are connected with each other by one side thereof, the rear baffle is connected to another side of one of the spacers, the shielding sheet is assembled in the accommodating space of the main body through the second opening, the spacers are located correspondingly between the adjacent terminals to space apart the terminals, and the rear baffle is arranged near the third opening of the main body.

Therefore, the electrical connector having the shielding function of the present disclosure has the effects as below. The electrical connector has the shell, the main body, the plurality of sleeves, the plurality of terminals, the plurality of terminal seats, and the shielding sheet. The spacers of the shielding sheet are configured to space apart the terminals to prevent signal interference among the adjacent terminals. The rear baffle of the shielding sheet is configured to insulate the terminals in the rear from the external environment to prevent interference from an external magnetic field to the terminals. Since the shielding sheet has a double shielding effect, a signal transmission process is not affected by the adjacent terminals and the external environment, such that the electrical connector can effectively achieve a shielding effect and a relatively high data transmission speed, and the manufacturing cost is reduced.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
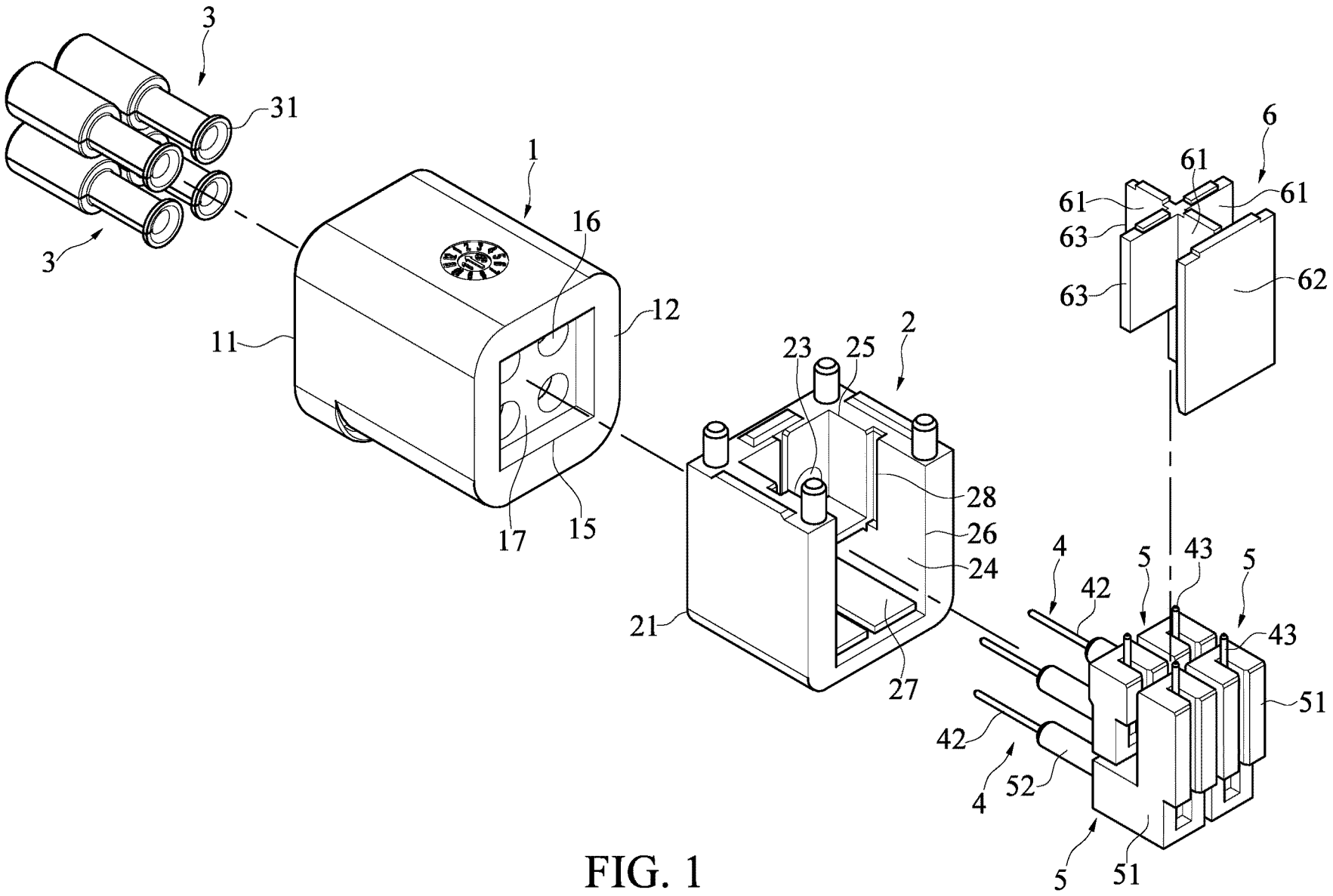
FIG. 1 is a perspective exploded view of an electrical connector having a shielding function of the present disclosure according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Figure 2:
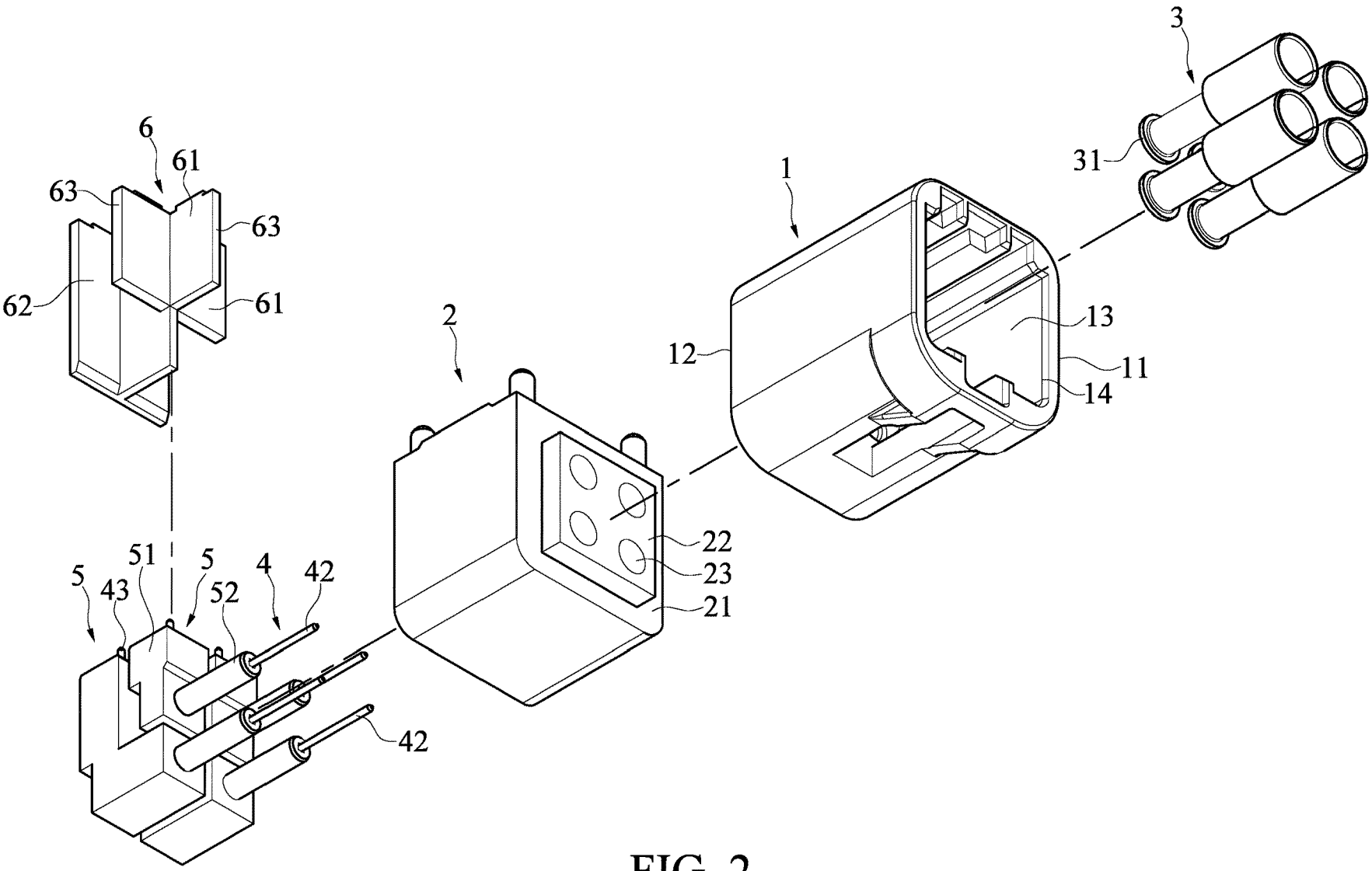
FIG. 2 is a perspective exploded view of the electrical connector having the shielding function of the present disclosure from another viewing angle according to the embodiment of the present disclosure.
Figure 3:
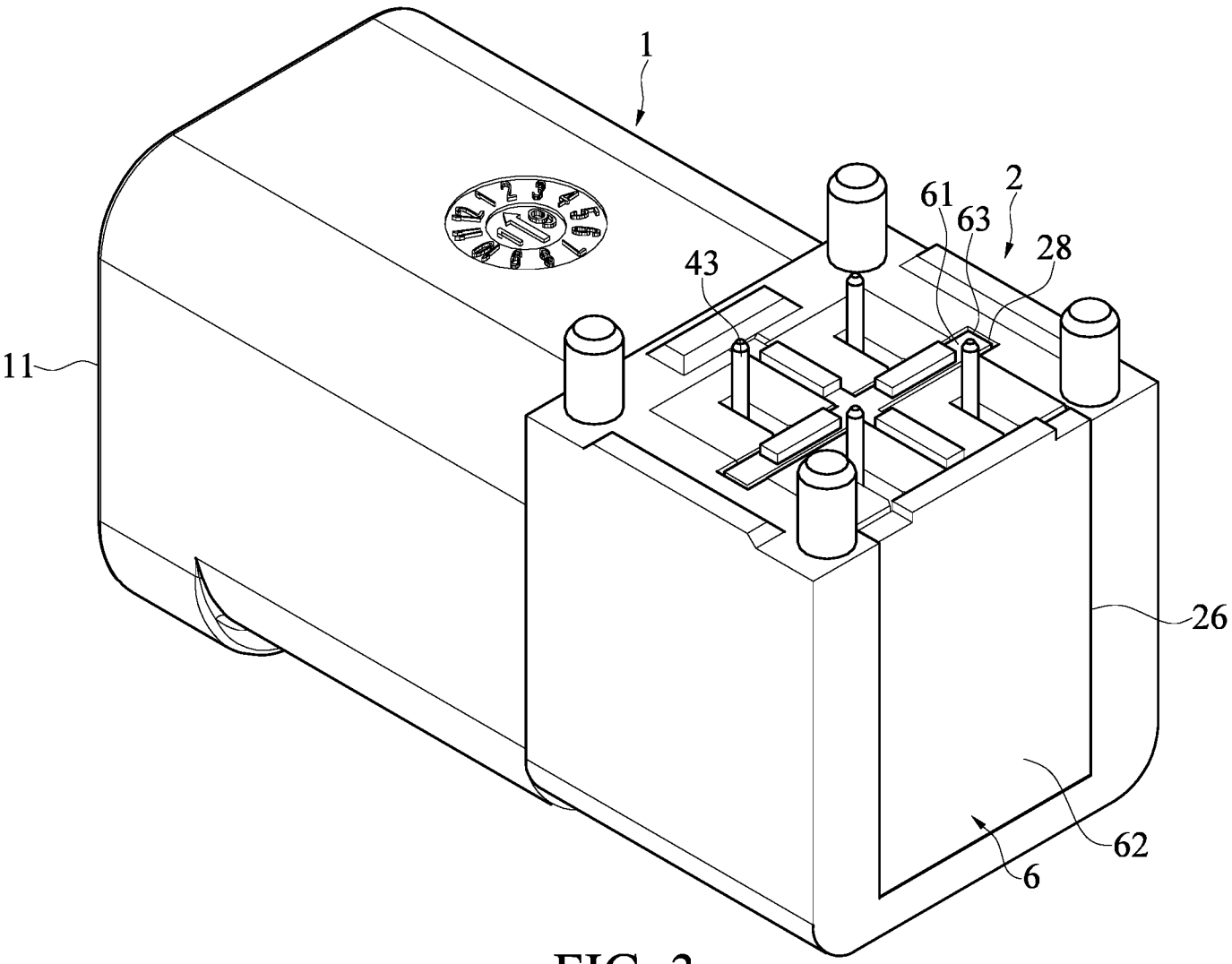
FIG. 3 is a perspective view of the electrical connector having the shielding function of the present disclosure according to the embodiment of the present disclosure.
Figure 4:
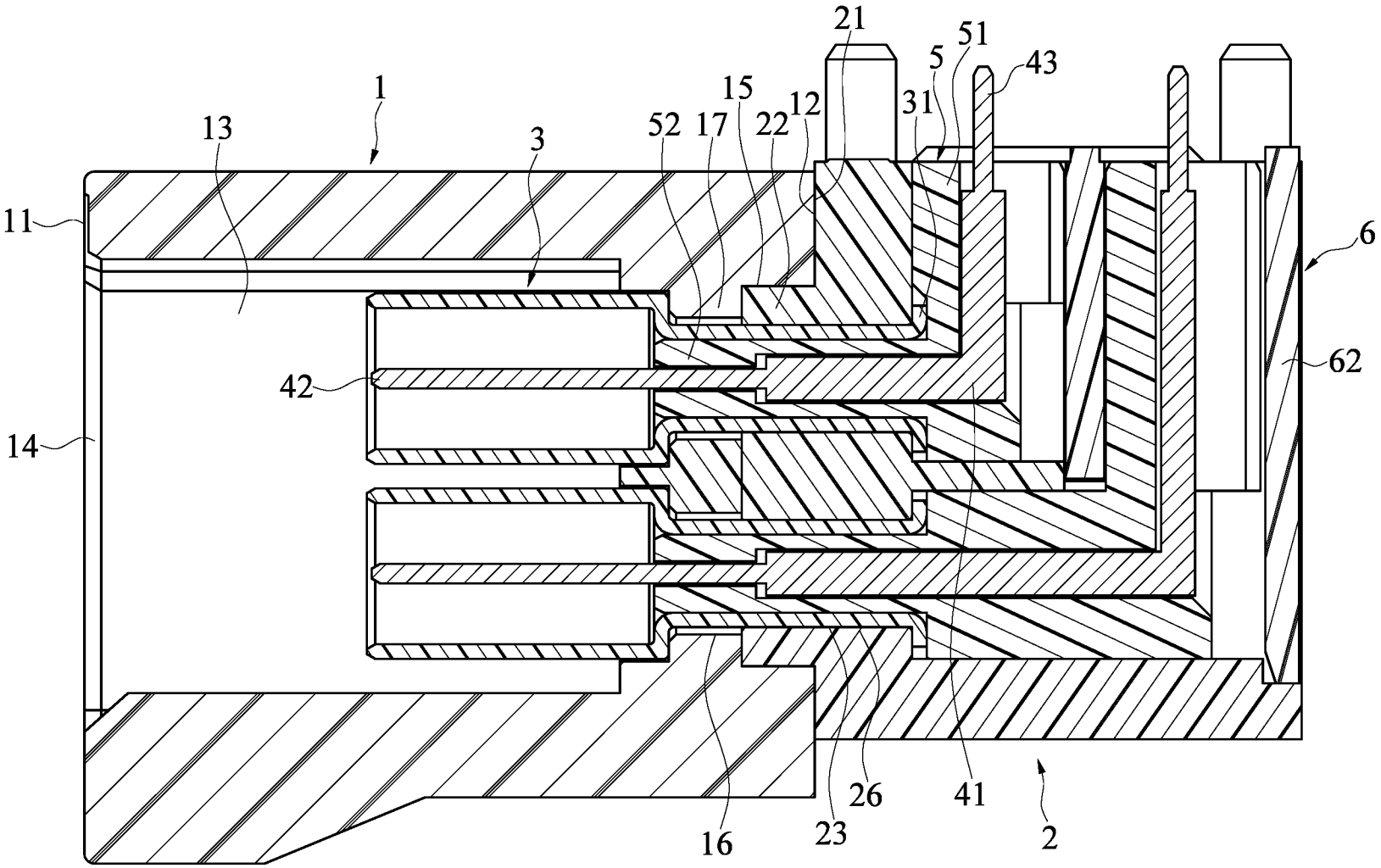
FIG. 4 is a sectional view of the electrical connector having the shielding function of the present disclosure according to the embodiment of the present disclosure.
Figure 5:
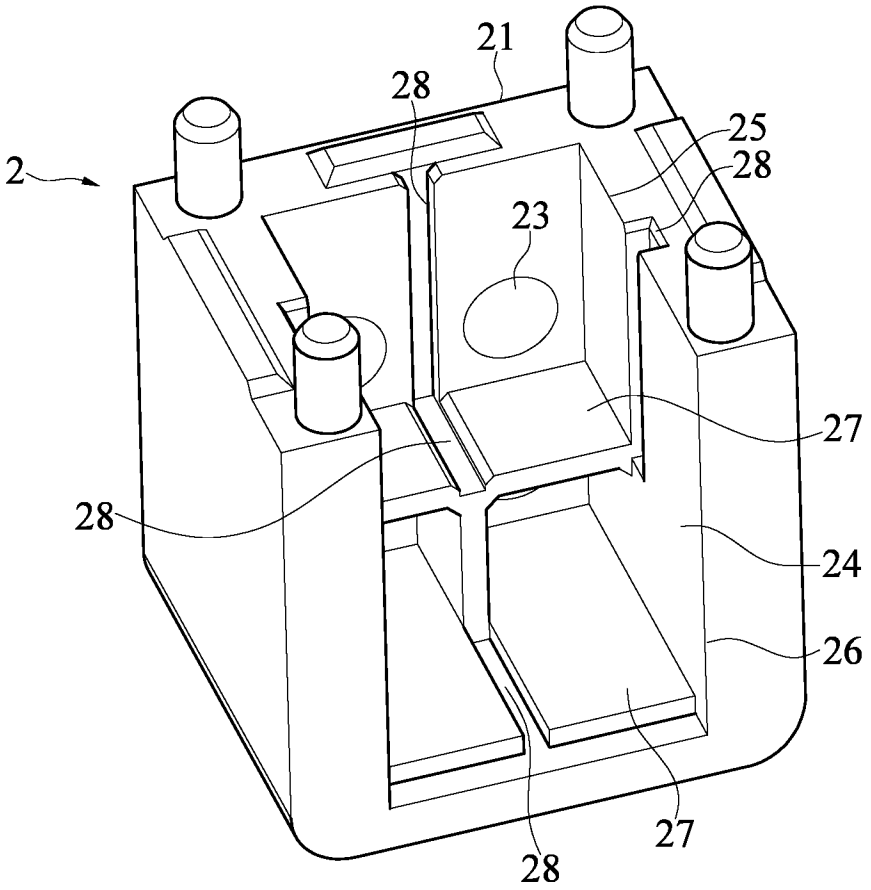
FIG. 5 is a perspective view of a main body of the present disclosure according to the embodiment of the present disclosure.

Referring to FIG. 1 to FIG. 5, the present disclosure provides an electrical connector having a shielding function, and the electrical connector includes a shell 1, a main body 2, a plurality of sleeves 3, a plurality of terminals 4, a plurality of terminal seats 5, and a shielding sheet 6.

The shell 1 is made of an insulation material such as plastic, and the shell 1 is substantially in a cubical structure. The corresponding two sides (i.e., a front side and a rear side) of the shell 1 respectively have a mating end 11 and a first connection end 12. The shell 1 has a mating space 13 inside thereof, a first opening 14 is formed on the mating end 11, and the first opening 14 is in spatial communication with the mating space 13 so that a mating connector can be inserted into the mating space 13 through the first opening 14.

In the present embodiment, the first connection end 12 can have a recess 15 that extends to a suitable depth within the shell 1. The shell 1 can have a plurality of first assembling holes 16 formed therein, and each of the first assembling holes 16 can be a circular hole. The first assembling holes 16 can be arranged on a separator 17, and the separator 17 is between the mating space 13 and the recess 15. Preferably, a distance between the separator 17 and the mating end 11 is greater than a distance between the separator 17 and the first connection end 12 so that the separator 17 is relatively closer to the first connection end 12.

The main body 12 is preferably made of zinc alloy so that the main body 12 has a preferable shielding effect. The main body 2 is substantially shaped in a cubical structure. A second connection end 21 is formed on one side of the main body 2, and the second connection end 21 of the main body 2 is connected with the first connection end 12 of the shell 1 so that the shell 1 and the main body 2 are connected together. In the present embodiment, the second connection end 21 can have a protrusion 22 that is corresponding to the recess 15, and the protrusion 22 can be engaged with the recess 15 so that the second connection end 21 of the main body 2 and the first connection end 12 of the shell 1 can be connected with each other. The main body 2 can have a plurality of second assembling holes 23 formed therein. Each of the second assembling holes 23 can be a circular hole. The second assembling holes 23 extend to the second connection end 21 and the protrusion 22, and the second assembling holes 23 are respectively corresponding to the first assembling holes 16.

The main body 2 has an accommodating space 24 inside thereof. The main body 2 has a second opening 25 formed on one side thereof near the second connection end 21, and the main body 2 has a third opening 26 formed on one side thereof away from the second connection end 21. The second connection end 21 and the third opening 26 can be arranged on the corresponding two sides of the main body 2. The second opening 25 and the third opening 26 can be arranged at two sides of the main body 2 that are adjacent and perpendicular to each other. The second opening 25 and the third opening 26 are in spatial communication with the accommodating space 24, and each of the two sides of the main body 2 have an opening structure so that the terminals 4, the terminals seats 5, the shielding sheet 6, and other components can be easily assembled.

Each of the sleeves 3 can be a stamping member, and each of the sleeves 3 can be made of copper. Each of the sleeves 3 can be made of a material with higher electrical conductivity, such as copper, and each of the sleeves 3 can be of different specifications according to practical requirements. Each of the sleeves 3 can be cylindrical. The sleeves 3 are fixed on the shell 1 and the main body 2 and extend into the mating space 13. In the present embodiment, the sleeves 3 are disposed in the corresponding first assembling holes 16 and corresponding second assembling holes 23. In other words, a rear half of each of the sleeves 3 is configured to penetrate through the corresponding one of the first assembling holes 16 and the corresponding one of the second assembling holes 23, and one end (i.e., a rear end) of each of the sleeves 3 can be folded outwards to form a positioning portion 31. The positioning portion 31 of each of the sleeves 3 can abut against an inner surface of the main body 2 to prevent each of the sleeves 3 from slipping and loosening towards the mating space 13. The shell 1, the main body 2, and the sleeves 3 of the present disclosure can be simply assembled in combination without any other securing components, so that the overall structure is simplified and the cost is reduced. In the present embodiment, the quantity of the sleeves 3, the terminals 4, and the terminal seats 5 are four, but the quantity of the sleeves 3, the terminals 4, and the terminal seats 5 are not limited in the present disclosure. A separation design between the sleeves 3 and the main body 2 enables the sleeves 3 to be of different specifications, thereby providing a preferable versatility and reducing the cost.

Each of the terminals 4 can be made of a material with higher electrical conductivity, such as copper, and each of the terminals 4 can be in an L shape. Each of the terminals 4 has a fixing portion 41, a contacting portion 42, and a pin 43. The contacting portion 42 is connected to one end of the fixing portion 41, the pin 43 is connected to another end of the fixing portion 41, and the contacting portion 42 and the pin 43 are perpendicular to each other.

Each of the terminal seats 5 can be made of an insulation material such as plastic. The fixing portions 41 of the terminals 4 are respectively fixed on the terminal seats 5 so that the terminals 4 are respectively disposed on the terminal seats 5. The contacting portions 42 and the pins 43 of the terminals 4 extend out of the terminal seats 5. The terminal seats 5 and the terminals 4 are disposed in the accommodating space 24 of the main body 2, and the terminal seats 5 are partially and respectively embedded into the sleeves 3 so that the contacting portions 42 of the terminals 4 respectively extend into the sleeves 3, and the contacting portions 42 of the terminals 4 and the sleeves 3 are coaxially disposed. The terminal seats 5 and the terminals 4 are assembled in the accommodating space 24 through the third opening 26. In other words, the terminal seats 5 and the terminals 4 are assembled in the accommodating space 24 from back to front through the third opening 26, and the terminal seats 5 and the terminals 4 are assembled in the accommodating space 24 along a mating direction of the electrical connector.

In the present embodiment, each of the terminal seats 5 has a seat body 51 and a column body 52. One end of the column body 52 is connected to the seat body 51. The fixing portions 41 of the terminals 4 are respectively fixed in the seat bodies 51 and the column bodies 52 of the terminal seats 5, so that the terminals 4 are respectively disposed on the terminal seats 5, and the contacting portions 42 and the pins 43 of the terminals 4 respectively extend out of the column bodies 52 and the seat bodies 51 of the terminal seats 5. The column body 52 of each of the terminal seats 5 is respectively inserted into the corresponding one of the sleeves 3, specifically a rear half of the corresponding one of the sleeves 3, so that the contacting portion 42 of the corresponding one of the terminals 4 extends into the corresponding one of the sleeves 3, specifically a front half of the corresponding one of the sleeves 3. The seat bodies 51 of the terminal seats 5 can be pressed on the positioning portions 31 of the sleeves 3 so that the sleeves 3 are more stably maintained at fixed positions.

In the present embodiment, the main body 2 further has a plurality of carrying surfaces 27 disposed therein. The carrying surfaces 27 are configured to carry the terminal seats 5 so that the terminal seats 5 are more stably disposed within the accommodating space 24 of the main body 2. Since the terminal seats 5 are located at different heights, the carrying surfaces 27 are also located correspondingly at different heights so that the carrying surfaces 27 are formed into a stepped structure. More specifically, a height of the carrying surface 27 near the second connection end 21 is relatively higher, and a height of the carrying surface 27 away from the second connection end 21 is relatively lower, so that the carrying surfaces 27 can bear the weight of the terminal seats 5.

The shielding sheet 6 is preferably made of zinc alloy so as to provide a preferable shielding effect. The shielding sheet 6 can be integrally formed as a one-piece structure. The shielding sheet 6 has a plurality of spacers 61 and a rear baffle 62. In the present embodiment, the shielding sheet 6 has four spacers 61, the spacers 61 are connected with each other by one side thereof, and the rear baffle 62 is connected to another side (or a rear side) of one of the spacers 61. In the present embodiment, the spacers 61 have equiangular spaces (i.e., an angle between two spacers 61 is 90 degrees) arranged therebetween, and the rear baffle 62 is perpendicular to one of the spacers 61 connected to the rear baffle 62. The shielding sheet 6 of the present embodiment is in a shape similar to the Chinese character "±", which means "earth" in English, and the shielding sheet 6 has multiple shielding effects.

The shielding sheet 6 is assembled in the accommodating space 24 of the main body 2. The spacers 61 are arranged among the adjacent terminal seats 5. In other words, the spacers 61 are located correspondingly between the adjacent terminals 4 to space apart the terminals 4, thereby providing the shielding effects. The rear baffle 62 is arranged near the third opening 26 of the main body 2 (i.e., near a rear side of the main body 2) to insulate the two terminals 4 in the rear from the external environment, thereby providing the shielding effects. The main body 2 and the shielding sheet 6 are made of zinc alloy to provide preferable shielding effects.

The shielding sheet 6 is assembled in the accommodating space 24 through the second opening 25. In other words, the shielding sheet 6 is assembled in the accommodating space 24 through the second opening 25 from top to bottom (as the direction shown in FIG. 1 and FIG. 2), and the shielding sheet 6 is assembled in the accommodating space 24 along a direction perpendicular to the mating direction of the electrical connector. In the present embodiment, a plurality of embedding grooves 28 are arranged at a plurality of positions in the main body 2 near the spacers 61. The embedding grooves 28 are distributed on a plurality of inner wall surfaces of the main body 2, and a plurality of corresponding embedding ribs 63 are respectively disposed on the spacers 61. The embedding ribs 63 and the embedding grooves 28 are embedded with each other at a plurality of fixed positions so that the shielding sheet 6 is stably disposed in the accommodating space 24 of the main body 2, so as to prevent a fissure issue and improving the shielding effects. Preferably, the spacers 61 and the rear baffle 62 are perpendicular to the second opening 25, and the rear baffle 62 is parallel to the third opening 26.

In conclusion, the electrical connector having the shielding function of the present disclosure has the following effects. The electrical connector has the shell, the main body, the plurality of sleeves, the plurality of terminals, the plurality of terminal seats, and the shielding sheet. The plurality of spacers of the shielding sheet are configured to space apart the terminals to prevent signal interference among the adjacent terminals. The rear baffle of the shielding sheet is configured to insulate the terminals in the rear from the external environment to prevent an external magnetic field from affecting the terminals. Since the shielding sheet has a double shielding effect (i.e., a shielding effect among adjacent terminals and a shielding effect between the terminals and the external environment), a signal transmission process is not affected by the adjacent terminals and the external environment, the electrical connector can achieve an effective shielding effect and a relatively high data transmission speed, and the manufacturing cost is reduced. In addition, since each of the sleeves in the present disclosure is a stamping member that is made of copper, the shielding effects are good, and the manufacturing cost is low.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connector having a shielding function, comprising:

a shell having two corresponding sides that respectively have a mating end and a first connection end, wherein the shell has a mating space inside thereof, and wherein the mating end has a first opening, and the first opening is in spatial communication with the mating space;

a main body having a second connection end formed on one side thereof, wherein the second connection end of the main body and the first connection end of the shell are connected with each other, and wherein the main body has an accommodating space inside thereof, the main body has a second opening formed on one side thereof near the second connection end, the main body has a third opening formed on one side thereof away from the second connection end, and the second opening and the third opening are in spatial communication with the accommodating space;

a plurality of sleeves fixed on the shell and the main body, wherein the sleeves extend into the mating space;

a plurality of terminals each in an L shape, wherein each of the terminals has a fixing portion, a contacting portion, and a pin, the contacting portion is connected to one end of the fixing portion, the pin is connected to another end of the fixing portion, and the contacting portion and the pin are perpendicular to each other;

a plurality of terminal seats with the fixing portions of the terminals respectively fixed thereon, wherein the contacting portions and the pins of the terminals extend out of the terminal seats, the terminal seats and the terminals are assembled in the accommodating space of the main body through the third opening, the terminal seats are partially and respectively embedded into the sleeves, and the contacting portions of the terminals respectively extend into the sleeves; and a shielding sheet having a plurality of spacers and a rear baffle, wherein the spacers are connected with each other by one side thereof, the rear baffle is connected to another side of one of the spacers, the shielding sheet is assembled in the accommodating space of the main body through the second opening, the spacers are located correspondingly between the adjacent terminals to space apart the terminals, and the rear baffle is arranged near the third opening of the main body.

2. The electrical connector according to claim 1, wherein the first connection end has a recess, the shell has a plurality of first assembling holes formed therein, the first assembling holes are formed on a separator, and the separator is between the mating space and the recess, wherein the second connection end has a protrusion engaged with the recess, the main body has a plurality of second assembling holes formed therein, the second assembling holes extend to the second connection end and the protrusion, the second assembling holes correspond to the first assembling holes, and the sleeves are disposed inside of the corresponding first assembling holes and the corresponding second assembling holes.

3. The electrical connector according to claim 2, wherein a rear half of each of the sleeves penetrates through the corresponding one of the first assembling holes and the corresponding one of the second assembling holes, a rear end of each of the sleeves is folded outwards to form a positioning portion, and the positioning portion of each of the sleeves abuts against an inner surface of the main body.

4. The electrical connector according to claim 3, wherein each of the terminal seats has a seat body and a column body, one end of the column body is connected to the seat body, the fixing portion of each of the terminals is respectively fixed in the seat body and the column body of the corresponding one of the terminal seats, and the contacting portion and the pin of each of the terminals extend out of the seat body and the column body of the corresponding one of the terminal seats, and wherein the column bodies of the terminal seats are respectively inserted into the sleeves, and the seat bodies of the terminal seats are pressed on the positioning portions of the sleeves.

5. The electrical connector according to claim 1, wherein the main body and the shielding sheet are made of zinc alloy, and the shielding sheet is integrally formed as a one-piece structure.

6. The electrical connector according to claim 1, wherein the second connection end and the third opening are respectively arranged at corresponding two sides of the main body, the second opening and the third opening are arranged at two sides of the main body that are adjacent and perpendicular to each other.

7. The electrical connector according to claim 1, wherein each of the sleeves is a stamping member, and each of the sleeves is made of copper.

8. The electrical connector according to claim 1, wherein the spacers and the rear baffle are perpendicular to the second opening, and the rear baffle is parallel to the third opening.

9. The electrical connector according to claim 1, wherein a plurality of embedding grooves are arranged at a plurality of positions in the main body near the spacers, a plurality of corresponding embedding ribs are disposed on the spacers, and the embedding ribs and the embedding grooves are respectively embedded with each other at a plurality of fixed positions.

10. The electrical connector according to claim 1, wherein the quantity of the spacers is four, the spacers have equiangular spaces arranged therebetween, and the rear baffle is perpendicular to one of the spacers connected to the rear baffle.

* * * * *